US005542860A

United States Patent [19]

Bandura et al.

[11] Patent Number: 5,542,860

[45] Date of Patent: Aug. 6, 1996

[54] ELECTRICAL CONNECTOR WITH MOUNTING POST

[75] Inventors: Michael A. Bandura, Ottawa; Kirk B. Peloza, Naperville, both of Ill.

[73] Assignee: Molex Incorporated, Lisle, Ill.

[21] Appl. No.: 403,981

[22] Filed: Mar. 15, 1995

[51] Int. Cl.[6] ..... H01R 13/60

[52] U.S. Cl. ..... 439/567; 439/571

[58] Field of Search ..... 439/567, 571, 439/572

[56] References Cited

U.S. PATENT DOCUMENTS

| | | | |
|---|---|---|---|
| 3,815,077 | 6/1974 | Anhalt et al. | 339/17 CF |
| 4,195,900 | 4/1980 | Hughes | 439/571 |
| 4,734,043 | 3/1988 | Emert et al. | 439/65 |
| 5,122,075 | 6/1992 | Kile | 439/567 |
| 5,230,638 | 7/1993 | DiViesti | 439/567 |
| 5,328,389 | 7/1994 | Lewis et al. | 439/567 |
| 5,334,047 | 8/1994 | Lutsky | 439/544 |
| 5,336,110 | 8/1994 | Mosquera | 439/554 |
| 5,366,389 | 11/1994 | Kreutter | 439/571 |

FOREIGN PATENT DOCUMENTS 6-96817 4/1994 Japan .

*Primary Examiner*—Neil Abrams
*Assistant Examiner*—Yong Kim
*Attorney, Agent, or Firm*—Stephen Z. Weiss

[57] ABSTRACT

An electrical connector is adapted for surface mounting on a substrate such as a printed circuit board having a mounting hole of a given diameter. The connector includes a dielectric housing having a board-mounting face. An elongated mounting post projects from the board-mounting face for insertion into the mounting hole in the substrate. The elongated mounting post includes a plurality of longitudinally extending, circumferentially spaced, generally rigid ribs defining a circle having a diameter approximately equal to or less than the given diameter of the mounting hole. A plurality of flexible, longitudinally extending ribs are located alternatingly between the generally rigid ribs and define a circle having a diameter at least slightly greater than the given diameter of the mounting hole.

10 Claims, 1 Drawing Sheet

ELECTRICAL CONNECTOR WITH MOUNTING POST

FIELD OF THE INVENTION

This invention generally relates to the art of electrical connectors and, particularly, to an electrical connector for mounting to a printed circuit board or other substrate. Specifically, this invention relates to a connector mounting post which is insertable into a mounting hole in a substrate such as a printed circuit board.

BACKGROUND OF THE INVENTION

It has been known to use mounting posts projecting from a dielectric housing of an electrical connector to support the connector on a printed circuit board, a panel or other substrate to which the connector is to be mounted. The mounting posts are insertable into holes in the substrate to retain the connector thereon. For instance, it may be desirable to secure the connector to a printed circuit board prior to permanent connection such as by soldering the terminals of the connector to circuit traces on the printed circuit board.

It can be understood that dimensional tolerances between the mounting posts and the holes in the substrate are critical in providing a secure mounting of the connector on the substrate. Maintaining tight dimensional tolerances often is difficult and expensive if even possible. Extreme variances between the diameter of the hole in the substrate and the diameter of the mounting post could require excessive insertion forces that not only would render insertion of the mounting post in the hole difficult, but could cause the post to break.

Consequently, compliant or yieldable mounting posts have been designed to provide an interference fit within the mounting hole in the substrate. For instance, mounting posts with crushable ribs or wings have been designed to deform upon insertion. However, such crushable elements are prone to plastically take a "set". Flexible wings or ribs also have been used to accommodate tolerance variances between the mounting hole and the mounting post. However, such flexible components also cause problems because they are prone to overstress and break or lose their elasticity.

The present invention is directed to solving the above interrelated problems by providing a mounting post which has both flexible means to compensate for the aforementioned tolerances as well as generally rigid means to prevent overstressing of the flexible means.

SUMMARY OF THE INVENTION

An object, therefore, of the invention is to provide a new and improved electrical connector adapted for surface mounting on a substrate such as a printed circuit board.

In the exemplary embodiment of the invention, the substrate includes a mounting hole of a given diameter. It should be understood that the term give diameter is the specified diameter with tolerances to allow for dimensional variably anticipated from standard manufacturing practices. The connector includes a dielectric housing having a board-mounting face. An elongated mounting post projects from the board-mounting face for insertion into the mounting hole in the substrate.

The invention contemplates that the elongated mounting post include a plurality of longitudinally extending, circumferentially spaced, generally rigid ribs defining a circle having a diameter approximately equal to the given diameter of the mounting hole. A plurality of flexible, longitudinally extending ribs are located between the generally rigid ribs and define a circle having a diameter at least slightly greater than the diameter of the mounting hole. In the preferred embodiment, the generally rigid ribs define a circle having a diameter slightly less than the given diameter of the mounting hole.

As disclosed herein, the dielectric housing is molded of plastic material, with the mounting post being integral therewith. The flexible ribs have outer peripheral areas extending oblique to the inside surface of the mounting hole to facilitate flexing of the flexible ribs upon insertion into the mounting hole. Each of the generally rigid ribs has an outer edge formed on a radius. The mounting post has a distal end that is chamfered to facilitate guiding the mounting post into the mounting hole.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
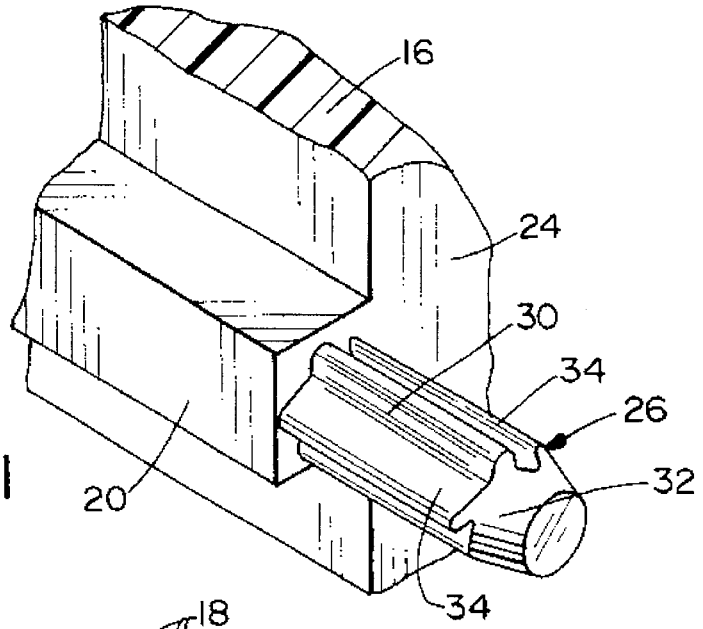
FIG. 1 is a fragmented perspective view of a portion of the bottom of an electrical connector, illustrating a mounting post embodying the concepts of the invention.
Figure 2:
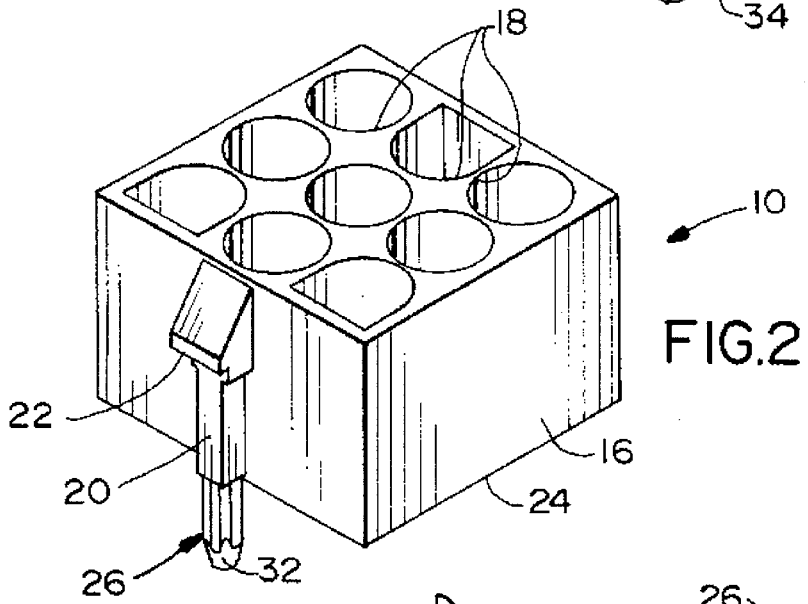
FIG. 2 is a perspective view of the top of the connector including the mounting post.

Referring to the drawings in greater detail, and first to FIGS. 1 and 2, the invention is embodied in an electrical connector, generally designated 10, adapted for mounting on a substrate 12 (FIG. 4) having a mounting hole 14 of a given diameter. The substrate may be a panel, a printed circuit board or the like.

Connector 10 includes a dielectric housing 16 molded of plastic material. The housing has a plurality of receptacles 18 (FIG. 2) for receiving the terminals or terminal-carrying portions of a complementary mating connector (not shown). A rib 20 is molded integrally on the exterior of one side of housing 16 and terminates in a latch 22 for interengagement with a cooperating latch on the complementary mating connector. The connector housing has a board-mounting face 24 from which a mounting post, generally designated 26, projects. Actually, the mounting post projects from the board-mounting face at the bottom of rib 20. The mounting post is adapted for insertion into mounting hole 14 in substrate 12 as described in greater detail hereinafter.

Figure 3:
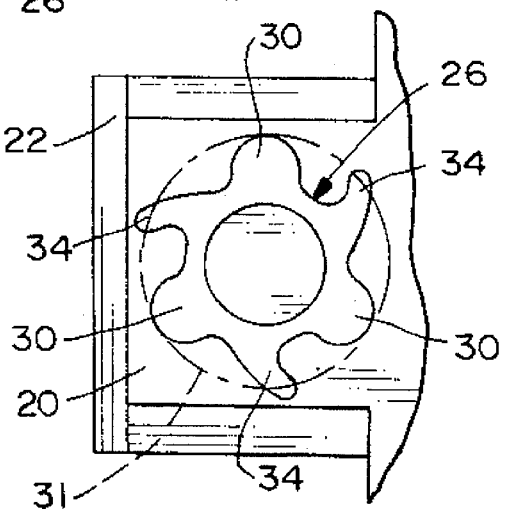
FIG. 3 is a fragmented bottom plan view of the portion of the connector having the mounting post.

More particularly, referring to FIG. 3 in conjunction with FIGS. 1 and 2, mounting post 26 is elongated and includes a plurality of longitudinally extending, circumferentially spaced, generally rigid ribs 30. The outer edge of each generally rigid rib 30 is formed on a radius, and the combined outer edges of the generally rigid ribs define a circle (shown in phantom at 31) having a diameter on the order of the given diameter of mounting hole 14 in substrate 12. Preferably, the generally rigid ribs define a circle having a diameter slightly less than the given diameter of the mounting hole. Therefore, the mounting post can be inserted into the hole with ease. The distal end of mounting post 26 is chamfered, as at 32 in FIG. 1, to facilitate guiding the mounting post into the mounting hole.

The invention also contemplates that mounting post 26 include a plurality of flexible, longitudinally extending ribs 34 located alternatingly between the generally rigid ribs 30. The outer extremities of flexible ribs 34 define a circle having a diameter at least slightly greater than the given diameter of mounting hole 14 in substrate 12. As best seen in FIG. 3, flexible ribs 34 have outer peripheral areas extending oblique to the axis of the mounting post. This allows the flexible ribs to elastically collapse radially inwardly upon insertion into mounting hole 14.

Figure 4:
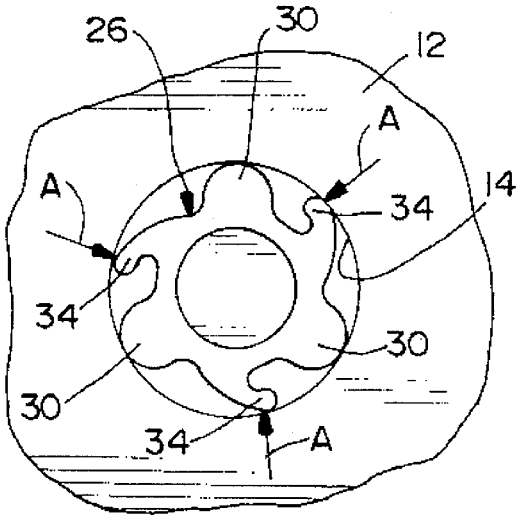
FIG. 4 is a bottom plan view of the mounting post having been inserted into a mounting hole in a substrate.

Referring to FIG. 4, mounting post 26 is shown as having been inserted into mounting hole 14 in substrate 12. It can be seen that the outer radiused edges of generally rigid ribs 30 barely engage the inside of the mounting hole to precisely locate the mounting post in the hole. In addition, it can be seen that flexible ribs 34 have been compressed inwardly in the direction of arrows "A". It can be understood how the inwardly flexing of ribs 34 is facilitated by orienting the ribs oblique to the axis of the mounting post which, in turn, compresses the ribs further to oblique conditions as shown in FIG. 4 upon insertion into the mounting hole. While generally rigid ribs 30 locate the mounting post within the hole, flexible ribs 34 establish an interference fit within the hole to hold the connector to the substrate. In addition, generally rigid ribs 30 perform a dual function of providing an anti-overstress means to prevent the flexible ribs from being overflexed radially inwardly. Therefore, the flexible ribs will not establish a "set" and the ribs are prevented from breaking because of undue flexing or downward force.

Lastly, it should be understood that referring to longitudinal ribs 30 as being "generally rigid", is meant in a relative context in relation to flexible ribs 34. With the connector housing, including integral mounting posts 26 being molded of plastic material, even ribs 30 are compliant to some degree due to the plastic material of which they are fabricated. On the other hand, since the ribs 30 have an outer edge formed on a radius, they are considerably more rigid or blunt in relation to the thinner oblique flexible ribs 34.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector adapted for surface mounting on a substrate such as a printed circuit board having a mounting hole of a given diameter, the connector including a dielectric housing having a board-mounting face, and an elongated mounting post projecting from said board-mounting face for insertion into the mounting hole in the substrate, wherein the improvement comprises:

said elongated mounting post including a plurality of longitudinally extending, circumferentially spaced, generally rigid ribs defining a circle having a diameter approximately the same as said given diameter of the mounting hole, and a plurality of flexible, longitudinally extending ribs located alternatingly between said generally rigid ribs and defining a circle having a diameter at least slightly greater than said given diameter of the mounting hole.

2. In an electrical connector as set forth in claim 1, wherein said generally rigid ribs define a circle having a diameter slightly less than said given diameter of the mounting hole.

3. In an electrical connector as set forth in claim 1, wherein said dielectric housing is molded of plastic material with said mounting post being integral therewith.

4. In an electrical connector as set forth in claim 1, wherein said flexible ribs have outer peripheral areas extending oblique to the inside surface of the mounting hole to facilitate flexing of the flexible ribs upon insertion into the mounting hole.

5. In an electrical connector as set forth in claim 1, wherein each of said generally rigid ribs has an outer edge formed on a radius.

6. In an electrical connector as set forth in claim 1, wherein said mounting post has a distal end that is chamfered to facilitate guiding the mounting post into the mounting hole.

7. An electrical connector adapted for surface mounting on a substrate such as a printed circuit board having a mounting hole of a given diameter, comprising:

a dielectric housing unitarily molded of plastic material and having a board-mounting face;

an elongated mounting post integral with the housing and projecting from said board-mounting face for insertion into the mounting hole in the substrate;

a plurality of longitudinally extending, circumferentially spaced, generally rigid ribs projecting radially of the elongated mounting post, each rib having an outer edge formed on a radius, and the combined outer edges of the ribs defining a circle having a diameter approximately equal to said given diameter of the mounting hole; and a plurality of flexible, longitudinally extending ribs located alternatingly between said generally rigid ribs and defining a circle having a diameter at least slightly greater than said given diameter of the mounting hole, the flexible ribs having outer peripheral areas extending oblique to the inside surface of the mounting hole to facilitate flexing of the flexible ribs upon insertion into the mounting hole.

8. The electrical connector of claim 7 wherein said generally rigid ribs define a circle having a diameter slightly less than said given diameter of the mounting hole.

9. The electrical connector of claim 7 wherein said flexible ribs are thinner than said generally rigid ribs.

10. The electrical connector of claim 7 wherein said mounting post has a distal end that is chamfered to facilitate guiding the mounting post into the mounting hole.

* * * * *